US005117879A

United States Patent [19]

Payne

[11] Patent Number: 5,117,879

[45] Date of Patent: Jun. 2, 1992

[54] SPLIT RING ROUTER MOUNT APPARATUS

[76] Inventor: Leslie O. Payne, 47342 SW. Scoggins Valley Rd., Gaston, Oreg. 97119

[21] Appl. No.: 759,286

[22] Filed: Sep. 13, 1991

[51] Int. Cl.[5] ..... B27C 5/10

[52] U.S. Cl. ..... 144/1 F; 144/134 D; 144/136 C; 409/182

[58] Field of Search ..... 144/1 F, 134 R, 134 D, 144/136 R, 136 C; 409/180, 182

[56] References Cited

U.S. PATENT DOCUMENTS 4,084,629 4/1978 Kreusler .
4,112,987 9/1978 Pachnik .
4,143,691 3/1979 Robinson ..... 144/134 D
4,273,483 6/1981 Mendicino ..... 144/136 C
4,312,391 1/1982 Snow ..... 144/1 F
4,319,860 3/1982 Beares .
4,880,042 11/1989 Schaffenkoffer ..... 144/134 D

*Primary Examiner*—W. Donald Bray
*Attorney, Agent, or Firm*—Henderson & Sturm

[57] ABSTRACT

A split ring router mount apparatus (10) adapted to releasably engage a conventional router (100) to a substrate; wherein the apparatus includes a collar unit (11) operatively engaged with the base (101) of the router and provided with a plurality of tongue elements (18); and, a base member (20) equipped with tang elements (25) that are adapted to releasably engage the tongue elements (18) on collar unit (11); and, wherein the base member (20) is provided with fastening elements (45) for operatively securing the base member (20) to a substrate.

5 Claims, 2 Drawing Sheets

SPLIT RING ROUTER MOUNT APPARATUS

TECHNICAL FIELD

The present invention relates to router attachments in general, and in particular to a router mount apparatus adapted to provide a means for releasable securing the router to a substrate such as a mounting board or a piece of machinery.

BACKGROUND ART

As can be seen by reference to the following U.S. Pat. Nos. 4,112,987; 4,084,629; 4,319,860; and 4,566,516; the prior art is replete with myriad and diverse router attachments.

While all of the aforementioned prior art constructions are more that adequate for the basic purpose and function for which they have been specifically designed, these prior art devices are uniformly deficient with regard to providing a means for quickly and easily engaging and disengaging the router relative to another price of equipment which serves as a substrate for the router.

In the past specialized mounting arrangements had to be fabricated to engage a router with a particular piece of machinery and the prior art was totally silent with regard to providing a universal mount for releasable securing a router to diverse substrates.

As a consequence of the foregoing situation, there has existed a longstanding need for a new router mount apparatus that has two cooperating portions; wherein, one portion is attached to the router; the other portion is attached to a given substrate; and, the two portions releasably engage one another; and, the provision of such a construction is a stated objective of the present invention.

DISCLOSURE OF THE INVENTION

Briefly stated, the router mount apparatus that forms the basis of the present invention comprises a split ring collar unit adapted to engage a conventional router; and a base unit operatively and releasably associated with the collar unit; wherein, the base unit is operatively attached to a substrate.

In addition both the collar unit and the base unit are provided with releasable capture elements which allows the collar unit to be quickly and easily engaged and disengaged relative to the base unit.

As will be explained in greater detail further on in the specification, this apparatus provides a simple and efficient means for quickly and easily operatively engaging the router with a plurality of diverse pieces of machinery; wherein, the router is equipped with the collar unit and each of the different substrates is equipped with a separate base unit thereby permitting the transfer of the router to a plurality of diverse substrates.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
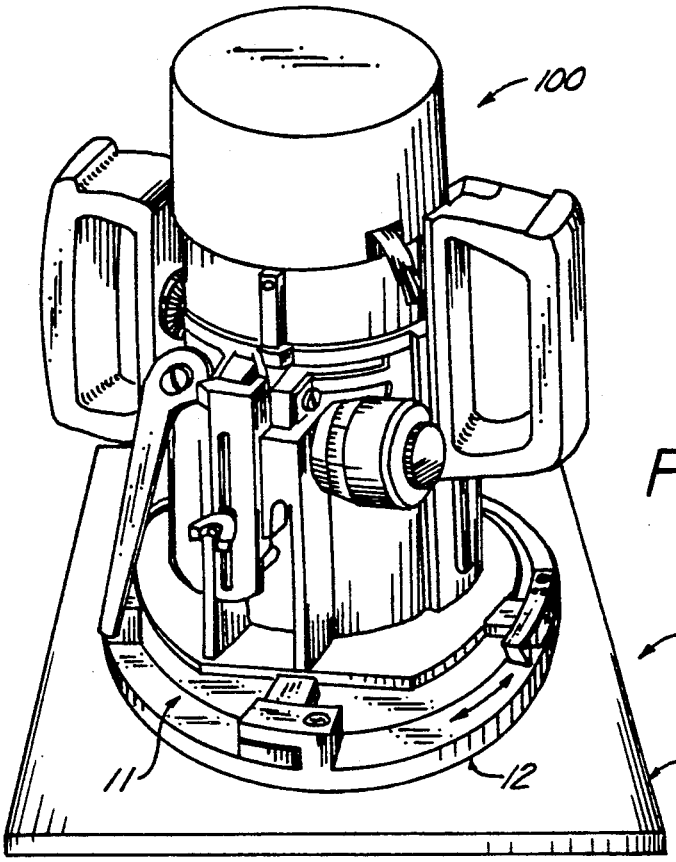
FIG. 1 is a perspective view of the split ring router mount apparatus that forms the basis of the present invention.

As can be seen by reference to the drawings, and in particular to FIG. 1, the split ring router mount apparatus that forms the basis of the present invention is designated generally by the reference numeral (101). The router mount apparatus (10) comprises in general: a split ring collar unit (11); a base unit (12); and, an optional mounting unit (13). These units will now be described in seriatim fashion.

Figure 4:
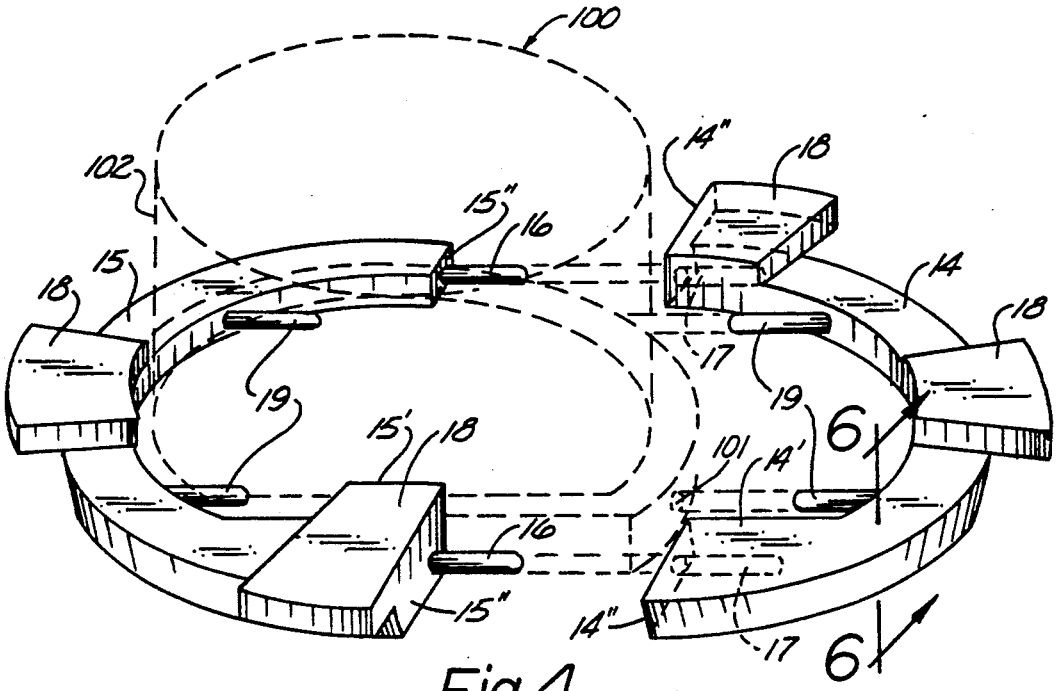
FIG. 4 is an exploded perspective view of the upper split ring collar unit.

As can best be seen by reference to FIG. 4, the split ring collar unit (11) comprises a pair of generally C-shaped rigid ring segments (14) (15) wherein the open ends of one of the ring segments (14) is provided with a pair of securing posts (16) and the open ends of the other ring segment (15) is provided with a pair of complementary dimensioned mounting apertures (17); whereby the ring segments (14) and (15) may be operatively joined together in a well recognized fashion.

Still referring to FIG. 4 it can be seen that each of the ring segments (14) (15) are provided with opposed generally straight interior wall portions (14') (15') along one side of the interior of the collar unit (11). Furthermore each of the ring segments (14) and (15) has one open end (14") (15") which is longer than the other open end (14"') and (15"'); wherein, the longer open ends (14") and (15") and the midpoints of the ring segments (14) and (15) are provided with outwardly projecting tongue elements (18).

In addition the interior surfaces of the ring segments (14) and (15) are further provided with a plurality of inwardly projecting mounting pins (19) which are dimensioned to be received in the conventional mounting holes (101) provided in the base portion (102) of a router (100).

Figure 5:
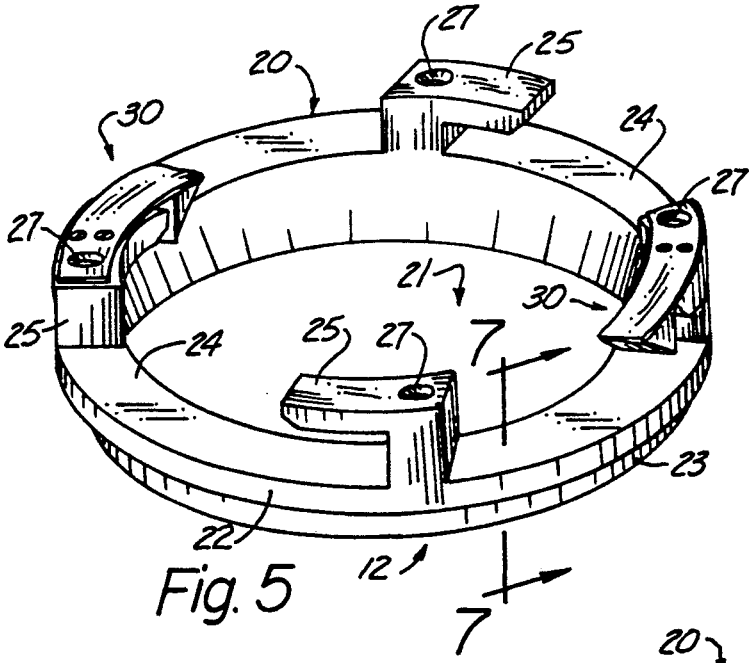
FIG. 5 is a perspective view of the lower base unit.
Figure 6:
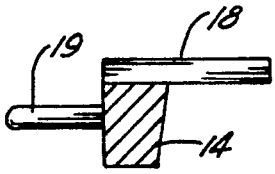
FIG. 6 is a cross-sectional view of the collar unit taken through line 6—6 of FIG. 4.
Figure 7:
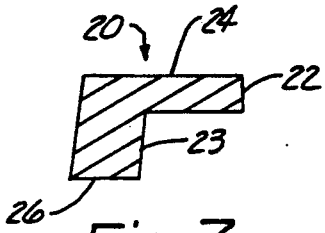
FIG. 7 is a cross-sectional view of the base unit taken through line 7—7 of FIG. 5.

Turning now to FIG. 5 it can be seen that the base unit (12) comprises a generally circular stepped shoulder base member (20) having an enlarged generally uniform diameter central bore (21); wherein, the upper portion (22) of the base member (20) has an enlarged diameter external periphery; and, wherein, the lower portion (23) of the base member (20) is provided with a reduced diameter external periphery.

Figure 3:
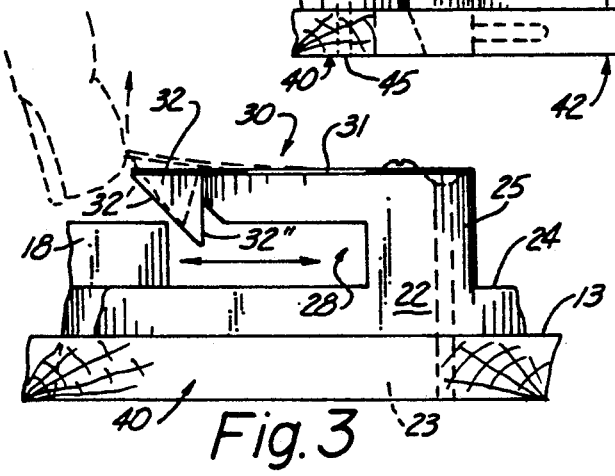
FIG. 3 is an isolated detail view of the operative engagement between the upper and lower portions of the apparatus.

In addition as shown in FIGS. 3, 5 and, 7 the upper surface (24) of the base member (20) is provided with a plurality of generally inverted and reversed L-shaped tang elements (25); and, wherein the lower surface (26) of the base member (20) is provided with a plurality of discrete threaded bores (27), whose purpose and function will be explained presently.

Figure 2:
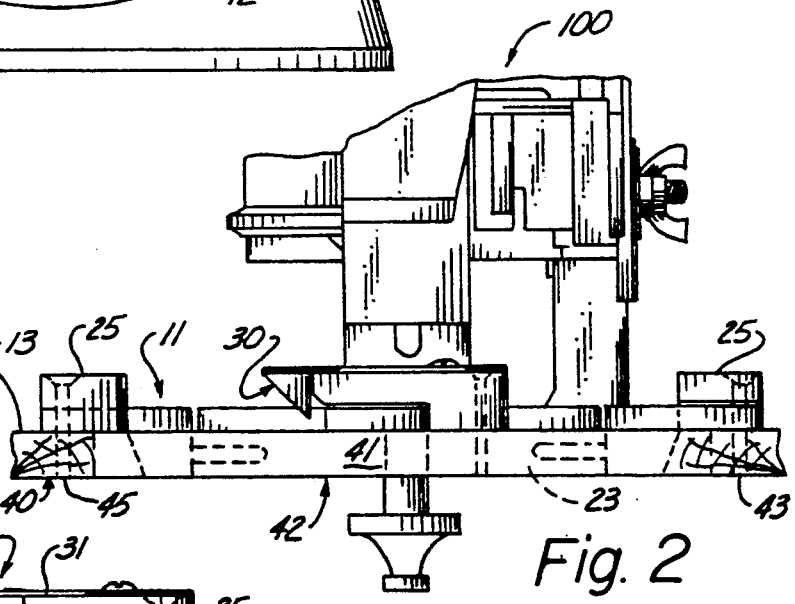
FIG. 2 is a side plan view of the router mount apparatus.

Furthermore as shown in FIGS. 2 and 3, at least some of the tang elements (25) on the top surface (24) of the base member (20) are provided with a spring loaded detent element (30) including a leaf spring (31) secured to the top of the tang elements (25) wherein the outboard end of the leaf spring (31) is provided with a downwardly depending generally triangular one way detent (32) having an angled outboard face (32') and a generally straight inboard face (32").

As can be appreciated particularly be reference to FIG. 3, the openings (28) formed in the tang elements (25) are dimensioned to receive the outwardly projecting tongues (18) on the split ring collar unit (11); wherein, the spring loaded detent elements (30) control at least some of the openings (28) to allow the free passage of the tongues (18) in the counterclockwise direction, while captively engaging the tongues (18) in the clockwise direction.

In one version of the preferred embodiment depicted in FIGS. 1 and 2 the apparatus (10) includes an optional mounting unit (13) which includes a mounting member (40) which in one instance comprises a mounting board element (41) having an enlarged aperture (42) dimensioned similar to the enlarged aperture (21) in the base member (20) and surrounded by a plurality of discrete apertures (43) dimensioned to receive elongated fastening elements (45) which will project through the mounting member (40) and engage the bores (27) in the base member (20) to secure the mounting member (40) to the base member (20) in a well recognized fashion.

As was mentioned previously, the router mount apparatus (10) of this invention is also adapted to be connected directly to diverse pieces of machinery (not shown); wherein, the optional mounting unit is dispensed with and the fastening elements (45) are used to secure the base member (20) directly to the diverse pieces of machinery, in a well recognized manner.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A router mount apparatus adapted to releasably engage the base of a conventional router to a substrate wherein the mount apparatus comprises:

a split ring collar unit including a pair of generally C-shaped ring segments operatively and releasably connected together in an encircling fashion relative to the base of said router; wherein, each of the ring segments is provided with at least one outwardly projecting tongue element; and, a base unit including a base member provided with an enlarged central bore and a top surface on the base member provided with a plurality of tang elements each having an opening which is dimensioned to releasably receive at least one of the tongue elements on said ring segments for operatively securing: the base unit to the collar unit.

2. The apparatus as in claim 1; wherein, at least one of the plurality of tang elements is provided with a spring loaded detent element that is adapted to allow the passage in one direction of at least one of said plurality of tongue element into the opening in one of the tang elements, an to resist the passage of said tongue element relative to said one of the tang elements in the opposite direction.

3. The apparatus as in claim 2; wherein, the base element is provided with an enlarged external diameter upper portion and a reduced external diameter lower portion.

4. The apparatus as in claim 2; wherein, said base element is further provided with a lower surface having a plurality of discrete bores dimensioned to accommodate conventional fastening elements for connecting the base member to said substrate.

5. The apparatus as in claim 4; wherein, said substrate comprises an optional mounting unit including a mounting board having an enlarged aperture surrounded by a plurality of discrete apertures at least some of which are aligned with the said plurality of discrete bores in said base member; wherein, the discrete apertures are dimensioned to accommodate the conventional fastening elements for operatively securing said mounting board to said base member.

* * * * *